US006079930A

United States Patent [19]

Valdes-Rodriguez

[11] Patent Number: 6,079,930

[45] Date of Patent: Jun. 27, 2000

[54] APPARATUS FOR TENNIS BALL RETRIEVAL

[76] Inventor: Robert Valdes-Rodriguez, 401 E. Ontario, Apt. 3102, Chicago, Ill. 60611

[21] Appl. No.: 09/188,585

[22] Filed: Nov. 9, 1998

[51] Int. Cl.[7] ..... A63B 47/02; B60P 1/36

[52] U.S. Cl. ..... 414/440; 294/19.2

[58] Field of Search ..... 294/19.2; 15/79.1, 15/83, 84; 56/327.1, 328.1, 400.02, 400.03; 198/310, 520, 522; 414/437, 439–441

[56] References Cited

U.S. PATENT DOCUMENTS

| | | | |
|---|---|---|---|
| 3,888,370 | 6/1975 | Gamblin | 414/440 |
| 4,077,533 | 3/1978 | Meyer | 414/440 |
| 4,221,524 | 9/1980 | Morris | 414/439 |
| 4,461,504 | 7/1984 | Perez et al. . | |
| 4,735,544 | 4/1988 | Stotts | 414/440 |
| 4,844,527 | 7/1989 | Ray . | |
| 5,301,991 | 4/1994 | Chen et al. . | |
| 5,527,075 | 6/1996 | Jones et al. . | |

FOREIGN PATENT DOCUMENTS

| | | | |
|---|---|---|---|
| 2510415 | 2/1983 | France | 294/19.2 |
| 2555455 | 5/1985 | France | 414/439 |
| 2558380 | 7/1985 | France | 294/19.2 |
| 662058 | 9/1987 | Switzerland | 294/19.2 |
| 868230 | 5/1961 | United Kingdom | 414/441 |
| 8603419 | 6/1986 | WIPO | 294/19.2 |

*Primary Examiner*—Johnny D. Cherry
*Attorney, Agent, or Firm*—Michael I. Kroll

[57] ABSTRACT

The present invention discloses a generally upwardly standing wheeled cart 10 having a ground level scoop 22 on its front end wherein tennis balls 12 can be scooped up and routed upwardly through a hopper 41 into a ball basket 28 when the cart 10 is moved in the forward direction. The front wheels 16 of the cart have axles 46 which serve to drive a belt 40 having flexible projecting edges 42 which belt 40 is located on the inside of the cart 10 which belt 40 turns in a counter clockwise direction and forces the tennis balls 12 upwardly through the enclosure of the cart by trapping the balls between the belt 40 which is the width of the cart 10 and the rear wall 44 of the cart 10 wherewith the balls 12 are forced upwardly and out of the top of the cart 10 into a rear hanging basket 28. In an alternative embodiment of the present invention a canvas belt 54 is driven by a motor 52 with the belt 54 having hook and loop material 56 attached to it which serves as the surface upon which the tennis balls 12 are contacted and forced upwardly.

2 Claims, 6 Drawing Sheets

APPARATUS FOR TENNIS BALL RETRIEVAL

BACKGROUND OF THE INVENTION

1. Field of the Invention

The present invention relates generally to ball retrieval and, more particularly, to an apparatus that is pushed by the user having a first open end forwardly located wherein tennis balls are introduced as the apparatus travels and wherein the wheels having an axle which turns a belt counterclockwise, grips said tennis ball between said belt and one wall of the apparatus carrying the tennis ball to the top of said apparatus wherein the ball drops from the top opening of the apparatus into a detachable basket-like collector.

2. Description of the Prior Art

There are other ball collecting devices designed to aid in gathering together and/or picking up balls. Typical of these is U.S. Pat. No. 4,844,527 issued to Ray on Jul. 4, 1989.

Another patent was issued to Chen et al on Apr. 12, 1994 as U.S. Pat. No. 5,301,991. Yet another U.S. Pat. No. 5,527,075 was issued to Jones et al on Jun. 18, 1996 and still yet another was issued on Jul. 24, 1984 to Perez et al as U.S. Pat. No. 4,461,504.

U.S. Pat. No. 4,844,527

Inventor: Lynn L. Ray

Issued: Jul. 4, 1989

A multipurpose ball collector, ball storage and ball dispenser uses a wheel driven rotating shaft and fixed projections to positively collect balls, a wire cage to store balls and a folding handle with a folding cage door to conveniently allow withdrawing of the balls during practice. The folding handles are pivoted and attach to each other during collection to provide structural integrity. For dispensing, the handles are attached to the cage to form a structure which lifts the cage to within easy reach for the practicing player. Collection arms can also be provided to assist in ball collection or carrying the cage to a storage location.

U.S. Pat. No. 5,301,991

Inventor: Chen et al.

Issued: Apr. 12, 1994

A ball retrieving and storage cart generally comprises a wheeled carriage that rollingly supports a basket in a ball retrieving position. In an exemplary embodiment, the basket has a front end and a rear end and includes a bottom wall having two side members oriented front to rear and having a normal position spaced apart less than the ball diameter and defining a slotted aperture for entrance of a ball into the basket. In the ball retrieval position, at least one of the side members is a slanted member having a front end higher from the ground than a ball radius and a rear end lower to the ground than the ball radius. At least one of the side members is a deflectable member and is biased to the normal position but is sideways deflectable such that a ball on the ground entering the aperture sideways deflects the deflectable member sufficiently for the ball to pass into the basket. The wheels may define a rolling plane. The carriage includes a vertical frame member terminating in a push handle and the vertical frame member includes brackets for attaching a movable basket at a serving position higher that is than the ball retrieving position.

U.S. Pat. No. 5,527,075

Inventor: Jones et al.

Issued: Jun. 18, 1996

A portable golf ball retriever utilizing a knock down handle and a yoke formed from horizontal and depending side support members supporting an axle extending therethrough. A plurality of discs are rotatably affixed to the axle and fingers extend between the discs and the adjacent side support members to dislodge balls collected between the discs as the retriever is exposed thereto. A ball collecting device is releasably secured to the handle and yoke of a size to accommodate the handle, yoke, axle and plurality of discs and function as a carrying bag therefor. Handles are affixed to the collecting device to make it convenient to carry the container from place to place.

U.S. Pat. No. 4,461,504

Inventor: Perez et al.

Issued: Jul. 24, 1984

The structure includes a container having a bottom wall with slotted apertures having thin parallel side edge members through which tennis balls can be squeezed. At least one edge member of each aperture includes a roller to reduce the frictional resistance to the entry of the ball through the aperture. A support is provided for supporting the container with the bottom wall spaced above the supporting surface to prevent wear on the bottom wall.

While these ball collecting devices may be suitable for the purposes for which they were designed, they would not be as suitable for the purposes of the present invention, as hereinafter described.

SUMMARY OF THE PRESENT INVENTION

The present invention discloses a generally upwardly standing wheeled cart having a ground level scoop on its front end wherein tennis balls can be scooped up and routed upwardly through a hopper into a ball basket when the cart is moved in the forward direction. The front wheels of the cart have axles which serve to drive a belt having flexible projecting edges which belt is located on the inside of the cart which belt turns in a counter clockwise direction and forces the tennis balls upwardly through the enclosure of the cart by trapping the balls between the belt which is the width of the cart and the rear wall of the cart wherewith the balls are forced upwardly and out of the top of the cart into a rear hanging basket. In an alternative embodiment of the present invention a canvas belt is driven by a motor with the belt having hook and loop material attached to it which serves as the surface upon which the tennis balls are contacted and forced upwardly.

A primary object of the present invention is to provide an apparatus to pick up tennis balls and deposit them into a detachable basket.

Another object of the present invention is to provide an apparatus with an operator forwardly located wherethrough tennis balls would pass as the apparatus is pushed in a forward direction.

Yet another object of the present invention is to provide an apparatus having a pair of wheels oppositely located and having an axle which acts as a drive shaft for a rubber-like belt.

Still yet another object of the present invention is to provide an apparatus having a rubber-like belt which will grip the tennis balls to an adjacent wall as they pass into the front ground level aperture and roll said tennis balls to the top of the apparatus.

Yet another object of the present invention is to provide an apparatus having an upper open end and having a basket-like detachable container located under said opening wherein the tennis ball will drop.

Additional objects of the present invention will appear as the description proceeds.

The present invention overcomes the shortcomings of the prior art by providing a ball collecting apparatus having a ground level aperture wherein tennis balls will pass as the apparatus moves in a forward direction and the axle for the wheels acting as a belt driving shaft wherein said belt will grip the tennis balls and roll them up one wall of the apparatus where they will pass through a second opening and drop into a detachable basket-like collection device.

The foregoing and other objects and advantages will appear from the description to follow. In the description reference is made to the accompanying drawings, which form a part hereof, and in which are shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

DESCRIPTION OF THE PREFERRED EMBODIMENT(S)

Figure 1:
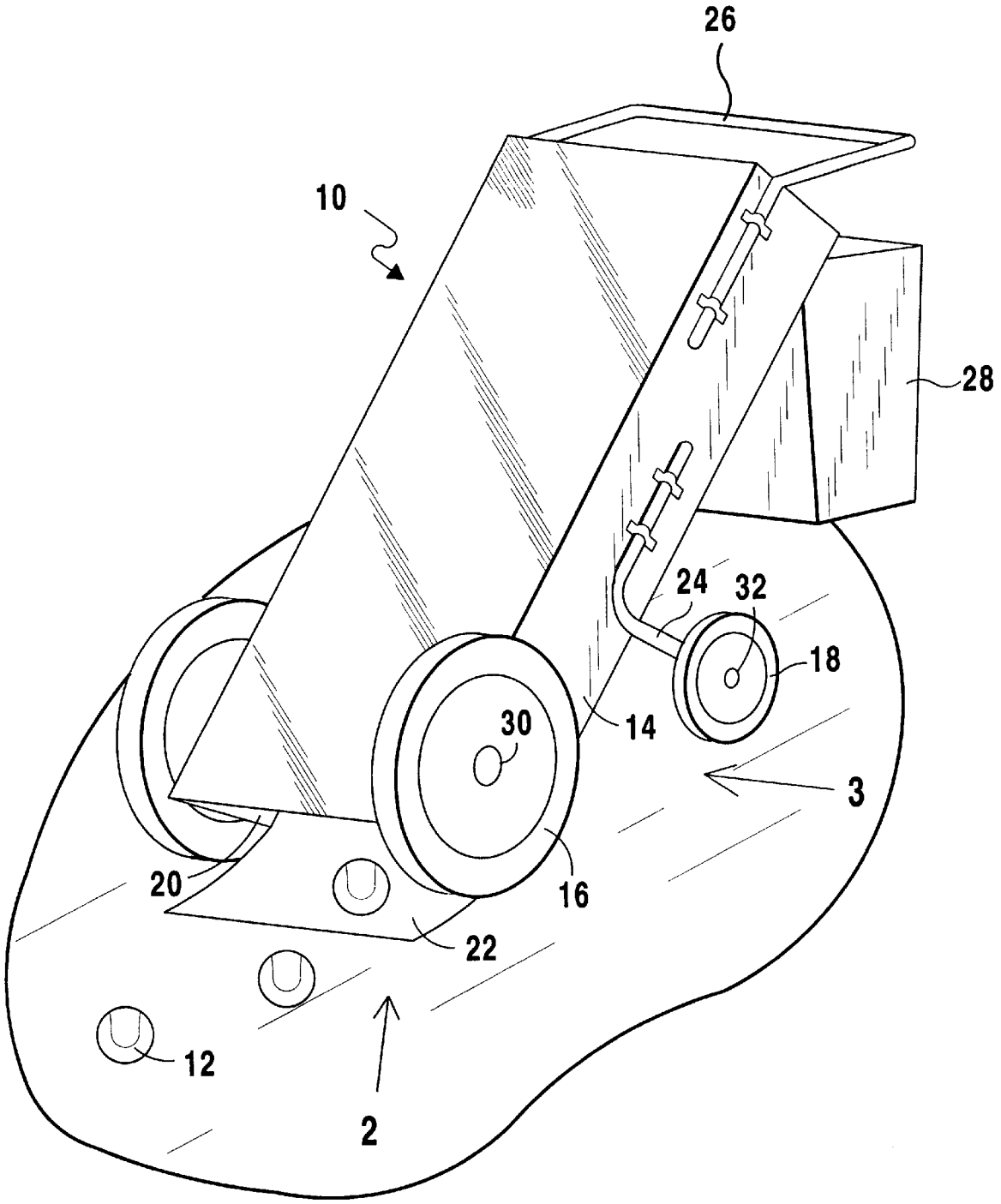
FIG. 1 is a perspective view of the present invention in use whereby the tennis ball collection apparatus is moved forwardly.

Turning now descriptively to the drawings, in which similar reference characters denote similar elements throughout the several views, FIGS. 1 through 6 illustrate the present invention. With regard to the reference numerals used, the following numbering is used throughout the various drawings.

| |
|---|
| 10 present invention |
| 12 balls |
| 14 enclosure |
| 16 front wheels |
| 18 rear wheels |
| 20 front opening |
| 22 ground scoop |
| 24 rear wheel mounts |
| 25 rear wheel attachments |
| 26 cart handle |
| 27 handle attachments |
| 28 basket |
| 30 axle of front wheel |
| 32 axle of rear wheel |
| 34 basket brace |
| 36 top cover |
| 38 base of cart |
| 40 belt |
| 41 hopper |
| 42 flexible edges |
| 44 rear wall |
| 46 axle of belt |
| 48 belt spacer |
| 49 spacer attachment means |
| 50 upper belt axle |
| 52 motor |
| 54 alternative belt |
| 56 belt hook and loop material |

Turning to FIG. 1, therein is shown a perspective view of the present invention generally shown at 10 in use, whereby the tennis ball 12 collection apparatus 10 is moving forwardly. Therein is shown the wheeled enclosure 14 of the present invention which serves as a wheeled cart 14 having wheels on the front 16 and rear wheels 18 upon which the cart 14 rolls and operates. The cart 14 is generally upwardly standing having on its lower front end an opening 20 for receiving tennis balls which are scooped into the opening 20 by a forward facing fixedly projecting ground level scoop or scraper 22 which positively collects balls. Also shown therein are the mounting means 24 for the rear wheels 18 and the push handle 26 attached to the upper end of the cart 14 along with the basket 28 which holds the tennis balls which are collected by the present invention 10. The basket is at a height for easy reach allowing for convenient withdrawal of the balls. Also shown therein are the front wheel axles 30 and the rear wheel axles 32.

Figure 2:
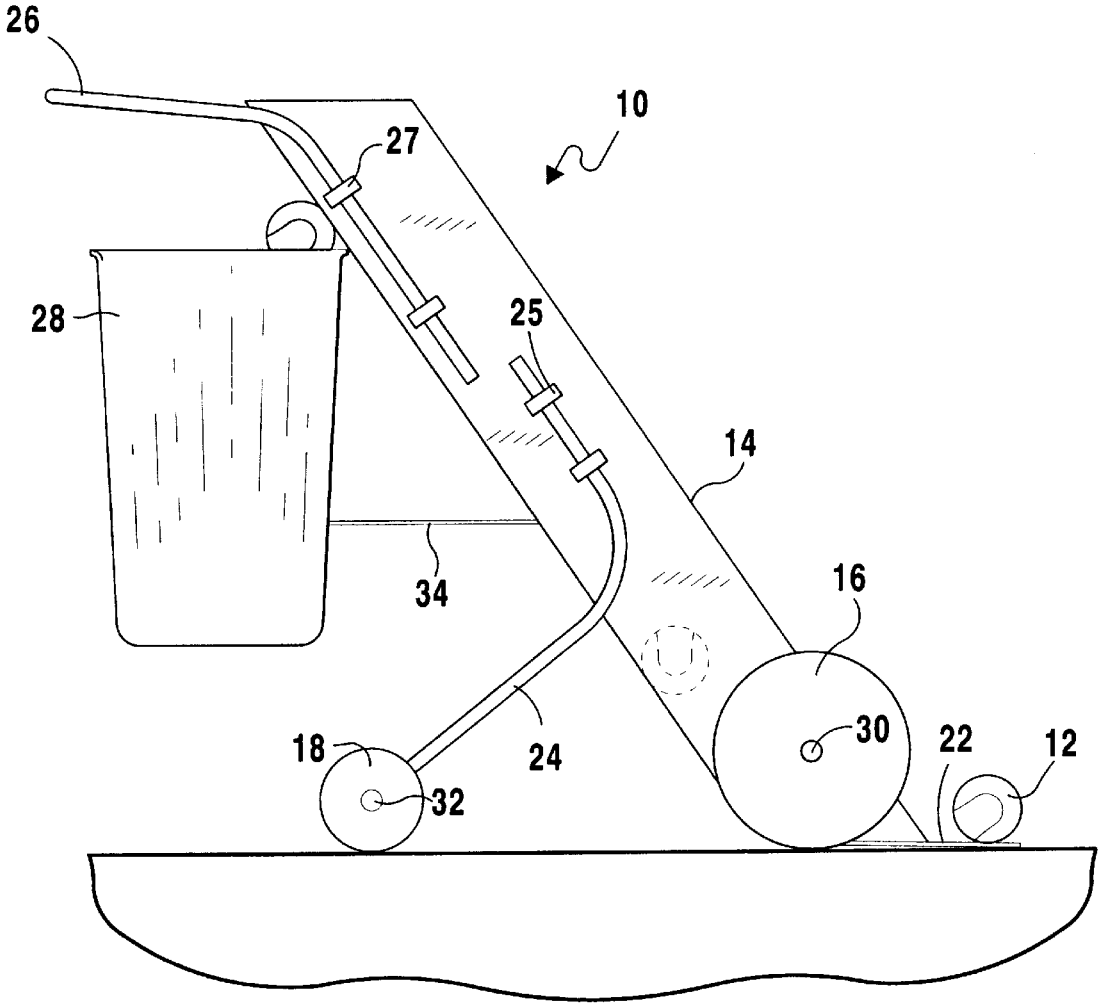
FIG. 2 is a side elevation of the present invention. Also shown are a number of tennis balls in outline being rolled to the hopper.

Turning to FIG. 2, therein is shown a side elevation of the present invention 10. Also shown are a number of tennis balls 12, some of which are in outline, being rolled into the hopper basket 28 by the scoop 22. Shown therein is the enclosure 14 of the present invention, the front wheels 16, the front wheel axles 30, the rear wheels 18 and axle 32, the rear wheel mounting brackets 24, along with the cart handle 26 and the basket 28. Also shown therein are means 25,27 for attaching the rear wheels to the cart and the handle to the cart. Also shown therein is the basket brace 34 for securing the basket to the cart 14 which brace 34 helps provide structural integrity to the basket 28 and cart 14.

Figure 3:
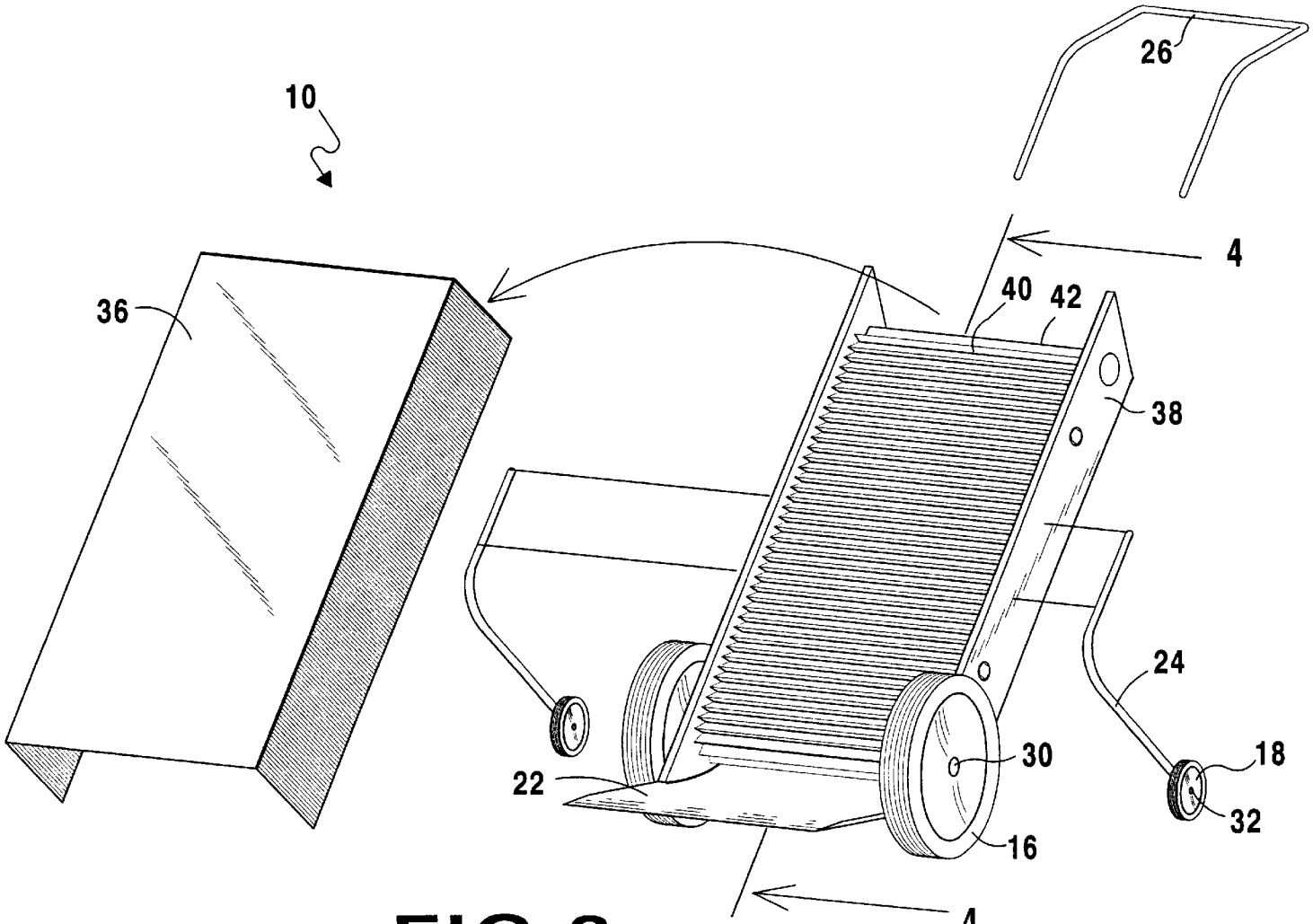
FIG. 3 is a front perspective view of the present invention, taken from FIG. 1 as indicated, with the top cover removed. Also shown is the rubber-like belt.

Turning to FIG. 3, therein is shown a front perspective view of the present invention 10 taken from FIG. 1 as indicated, with the top cover 36 removed. Shown therein is the base frame member 38 of the cart along with the front wheels 16, the front wheel axle 30, the front ground scoop 22, the rear wheels 18, the axle of the rear wheels 32, the rear wheel mounting brackets 24, and the cart handle 26. Also shown therein is the rubber-like belt 40 having flexible edges 42 on it which flexible edges extend perpendicular to the belt 40 to contact and aggressively engage balls and force them upwardly through the cart into the basket (not shown). The belt 40 extends across the full width of the base 38.

Figure 4:
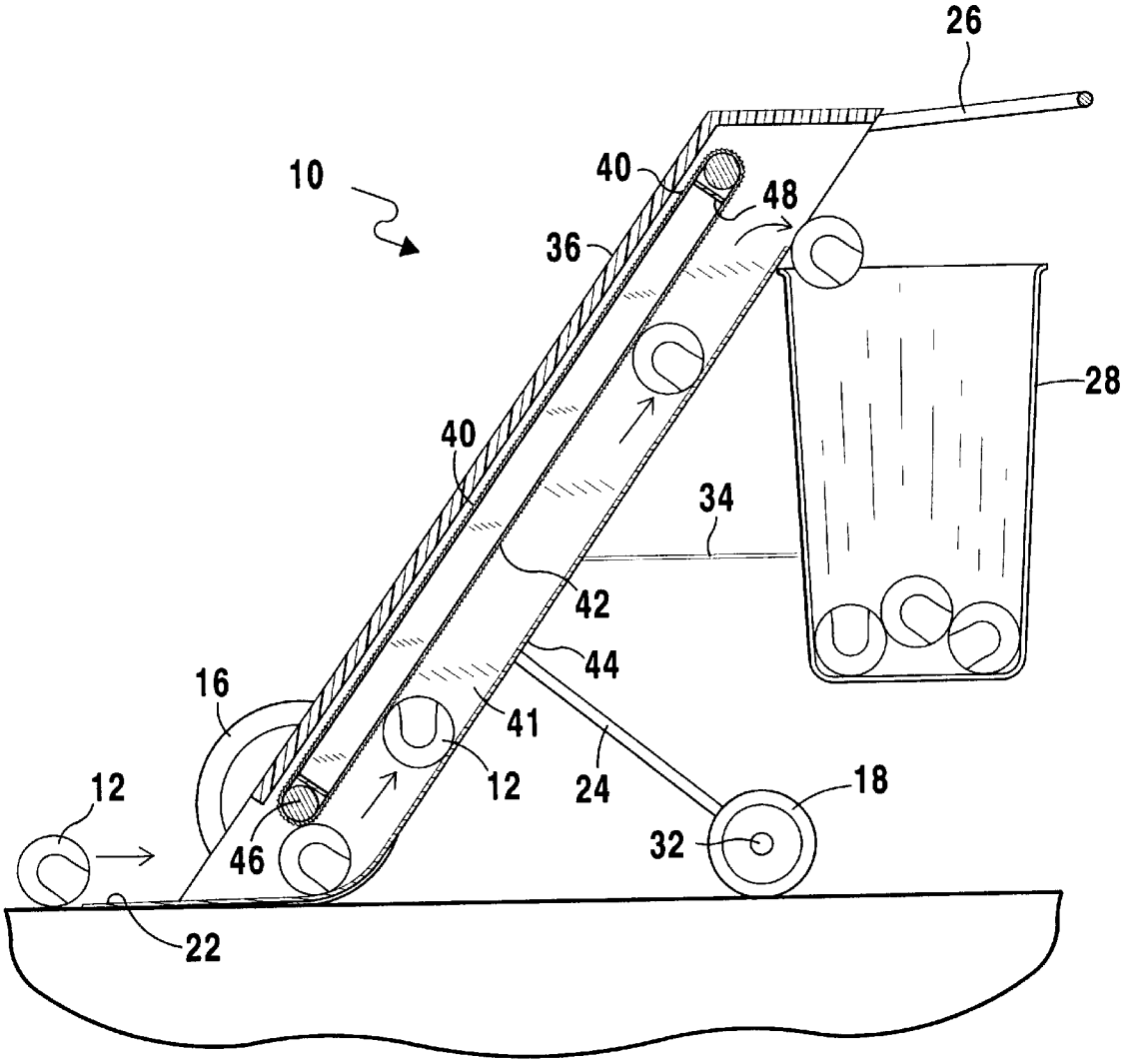
FIG. 4 is a cross sectional view of the present invention, taken from FIG. 3 as indicated, and shown are a number of tennis balls being rolled to the hopper by the compression of the balls between the rubber-like belt and the bottom wall of the apparatus.

Turning to FIG. 4, therein is shown a cross-section view of the present invention 10, taken from FIG. 3 as indicated. Shown therein are a number of tennis balls 12 being rolled through the hopper 41 by the compression of the balls 12 between the rubber-like belt 40 and a rear wall 44 of the present invention 10. The width of the hopper 41, or distance between the edges 42 of the belt 40 and the wall of the housing, is slightly less than the diameter of the balls 12 therefore firmly contacting the balls. Also shown therein are the front wheels 16 along with the axle 46 of the belt 40 which axle 46 is contiguous with the axle 30 (not shown) of the front wheel 16. The wheel driven counterclockwise rotating shaft 46 extends through the cart 10 and drives the belt 40 which contacts the balls 12 and forces them upwardly through the hopper 41. As the front wheels 16 turn and rotate the front wheel axle 30 (not shown), the belt axle 46 is turned rotatably in a counter clockwise direction. As the belt 40 turns, the ball is trapped between the belt 40 and the rear wall 44 of the cart and the balls 12 are forced upward in the track or hopper 41 between the belt 40 and the rear wall 44 of the cart 10 until the ball 12 reaches the top of the cart and falls outwardly into the basket 28. Also shown therein are the rear wheels 18, the rear wheel axles 32, the rear wheel mounting bracket 24, the basket braces 34 along with the cart handle 26. Also shown is the front cover of the cart 36 along with a rectangular frame-like member 48 upon which the belt travels which serves as a belt spacer to properly align, position and space apart the belt 40 for contacting the balls 12.

Figure 5:
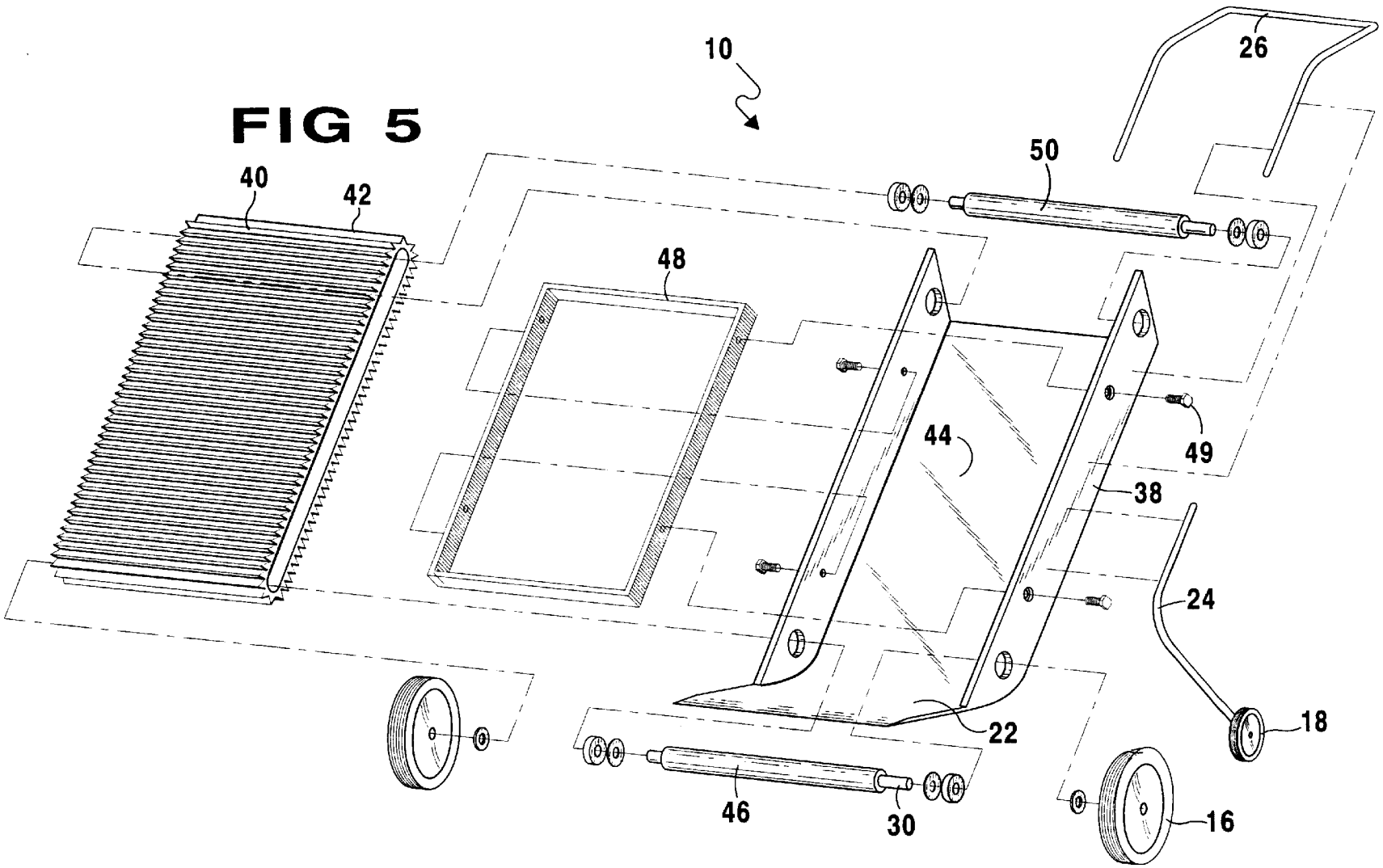
FIG. 5 is a front perspective exploded view of the present invention showing the major components of the present invention.

Turning now to FIG. 5, therein is shown a front perspective exploded view of the present invention 10 showing the major components of the present invention. Shown therein are the front wheels 16, the axles 30 of the front wheels and the belt axle 46 which is contiguous with the axle of the front wheel. Also shown therein are the rear wheels 18 and the rear wheel mounting braces 24. Also shown is the handle 26 along with the base 38 of the present invention. The rear wall 44 of the present invention is shown along with the belt 40 and the flexible edges 42 of the belt. Also shown therein is the inner belt spacer 48 with attachment means 49 upon which the belt 40 moves in order to keep the belt properly spaced apart. Also shown therein is the upper belt axle 50 upon which the belt rotates.

Figure 6:
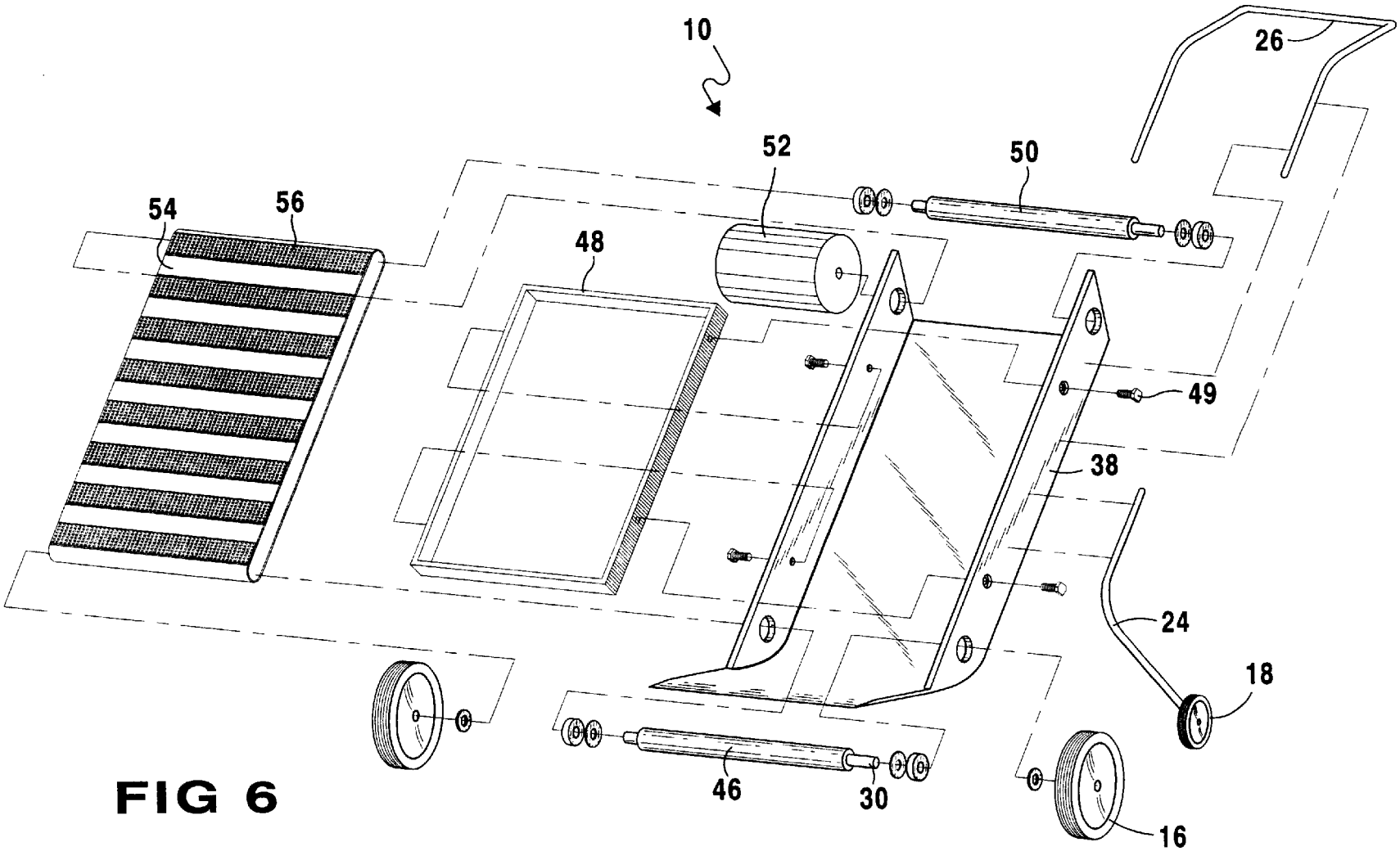
FIG. 6 is a front perspective exploded view of the present invention showing the major components of the present invention with the alternate embodiments of the motor and the canvas belt with hook and loop strips attached thereto.

Turning to FIG. 6, therein is shown an exploded perspective of the present invention 10 showing the major components of the present invention with the alternative embodiments being the motor 52 for driving the canvas belt 54 with hook and loop strips 56 attached thereto. Shown therein are the front wheels 16, the axles 30 of the front wheels and the belt axle 46 which is contiguous with the axle of the front wheel. Also shown therein are the rear wheels 18 and the rear wheel mounting braces 24. Also shown is the handle 26 along with the base 38 of the present invention. The rear wall 44 of the present invention is shown along with the belt 54. Note that the hook and loop strips 56 make contact with the balls and move the balls upwardly through the hopper. Also shown therein is the inner belt spacer 48 with attachment means 49 upon which the belt 54 moves in order to keep the belt properly spaced apart. Also shown therein is the upper belt axle 50 upon which the belt rotates.

What is claimed to be new and desired to be protected by Letters Patent is set forth in the claims:

1. An apparatus for collecting balls, comprising:

(a) a generally upwardly standing housing having an opening in an upper end and an opening in a bottom end of said housing with a handle to push said apparatus at said upper end;

(b) said housing having a pair of front wheels and a pair of rear wheels for movement, said housing extending back at an angle less than 90 degrees from the horizontal from said front wheels, said rear wheels supporting said housing along a midsection of said housing;

(c) said housing having means for collecting balls off the ground comprising a projecting member terminating at ground level and substantially tangential to the ground forward of said front wheels so that said projecting member scoops up balls as said apparatus is pushed;

(d) said housing containing means for engaging and transporting balls through said housing scooped up by said projecting member;

(e) a basket for receiving balls after collection whereby balls can be conveniently retrieved by the user, said basket being mounted behind said housing at said upper end adjacent the too opening;

(f) said means for engaging and transporting balls through said housing comprising a belt having projections with flexible edges thereon, said pair of front wheels having a wheel driven axle extending therethrough, said axle engaging and driving said belt as said apparatus is pushed along at ground level, said belt engaging said balls scooped up by said projecting member and transporting the balls through said housing by trapping the balls between said belt and a wall of said housing, the distance between said belt and said wall being less the diameter of the balls.

2. The apparatus of claim 1, said belt being of effectively the same width as said housing.

* * * * *